US005960567A

United States Patent [19]

Borel

[11] Patent Number: 5,960,567

[45] Date of Patent: Oct. 5, 1999

[54] SPORT BOOT PROVIDED WITH A TIGHTENING DEVICE SUCH AS A STRAP

[75] Inventor: Rene Borel, Cran-Gevrier, France

[73] Assignee: Salomon S.A., Metz-Tessy, France

[21] Appl. No.: 08/861,087

[22] Filed: May 21, 1997

[30] Foreign Application Priority Data

May 28, 1996 [FR] France ..... 96.06699

[51] Int. Cl.[6] ..... A43B 5/00

[52] U.S. Cl. ..... 36/50.5; 36/117.1

[58] Field of Search ..... 36/50.5, 50.1, 36/117.1, 118.3, 118.4, 118.5, 118.6, 118.7, 119.1

[56] References Cited

U.S. PATENT DOCUMENTS

| | | | |
|---|---|---|---|
| 3,561,139 | 2/1971 | Stillman . | |
| 4,575,955 | 3/1986 | Borsoi | 36/50.5 |
| 4,577,421 | 3/1986 | Sartor | 36/50.5 |
| 4,756,099 | 7/1988 | Walkhoff | 36/54 |
| 5,054,214 | 10/1991 | Sartor . | |
| 5,279,052 | 1/1994 | Perotto et al. . | |

FOREIGN PATENT DOCUMENTS

| | | | |
|---|---|---|---|
| 304404 | 2/1989 | European Pat. Off. | 36/50.5 |
| 0353532 | 2/1990 | European Pat. Off. . | |
| 442436 | 8/1991 | European Pat. Off. | 36/50.5 |
| 0500479 | 8/1992 | European Pat. Off. . | |
| 0569305 | 11/1993 | European Pat. Off. . | |
| 2607698 | 9/1972 | Germany | 36/117.1 |

*Primary Examiner*—M. D. Patterson
*Attorney, Agent, or Firm*—Greenblum & Bernstein, P.L.C.

[57] ABSTRACT

Sport boot of the type constituted by an upper extended at its upper portion by an open rigid collar whose free ends form overlapping portions that are foldable on one another to surround, and ensure the lateral holding of, the lower part of the leg of a user, by means of tightening strap connecting the overlapping portions to one another and having means for blockage into position, wherein the collar includes means for immobilizing the overlapping portions with respect to one another, in a substantially vertical plane, during taking of lateral support.

20 Claims, 1 Drawing Sheet

SPORT BOOT PROVIDED WITH A TIGHTENING DEVICE SUCH AS A STRAP

BACKGROUND OF THE INVENTION

1. Field of the Invention

The present invention relates to a sport boot of the type that requires a longitudinal mobility of the foot with respect to the leg and a proper retention of the ankle in the transverse direction, such as a boot that is more specifically adapted for walking (trekking), cross-country skiing (skating), or yet for in-line roller skating.

2. Background and Material Information

While such sports require the boot to have front and rear flexibility, i.e., front-rear bending for the foot with respect to the leg, in the direction of displacement, they also require lateral supports as well as a specific support for the ankle in the transverse direction.

To enable lateral support to be provided, sport boots are known, which are constituted by an external sole overlaid by an upper extended at its upper portion by an open rigid collar surrounding the user's ankle, and whose free ends form overlaps or overlapping portions that are positioned on one another to surround, and ensure the lateral holding of, the ankle or of the lower part of the leg (i.e, lower leg portion) of a user, by means of a tightening strap or the like connecting the overlapping portions to one another and provided with means for blockage into position.

However, there has been a lack of efficiency in lateral retention of these collars, because these overlapping portions have a tendency, when support is provided to the right or to the left with respect to the direction of walking, to be subjected to a rotational movement with respect to one another, in a substantially vertical plane, due to the tendency of the collar to twist in either direction.

SUMMARY OF THE INVENTION

The object of the present invention is to remedy the aforementioned disadvantage by proposing an improved boot whose collar resists the twisting better while the boot provides lateral support for the ankle and lower part of the leg.

To this end, the invention relates to a sport boot or footwear of the type constituted by a rigid collar surrounding the user's ankle, and whose free ends overlap one another and form overlapping portions that are foldable on one another to surround, and ensure the lateral holding of, the ankle or lower part of the leg of a user, by means of tightening means connecting the overlapping portions to one another, wherein the collar includes means for the mutual immobilization of the overlapping portions with respect to one another, i.e., along in a substantially vertical plane. Such immobilization means thus make it possible to stiffen the collar in particular when a lateral support is provided by the boot, by avoiding any phenomenon of relative displacement of the overlapping portions.

BRIEF DESCRIPTION OF DRAWINGS

The present invention also relates to the characteristics which will become apparent along the description that follows, and which are to be considered separately or according to all of their possible technical combinations.

This description, which is provided by way of a non-limiting example, will help to better understand how the invention can be embodied, with reference to the annexed drawing, in which.

DETAILED DESCRIPTION OF THE PREFERRED EMBODIMENTS

Figure 1:
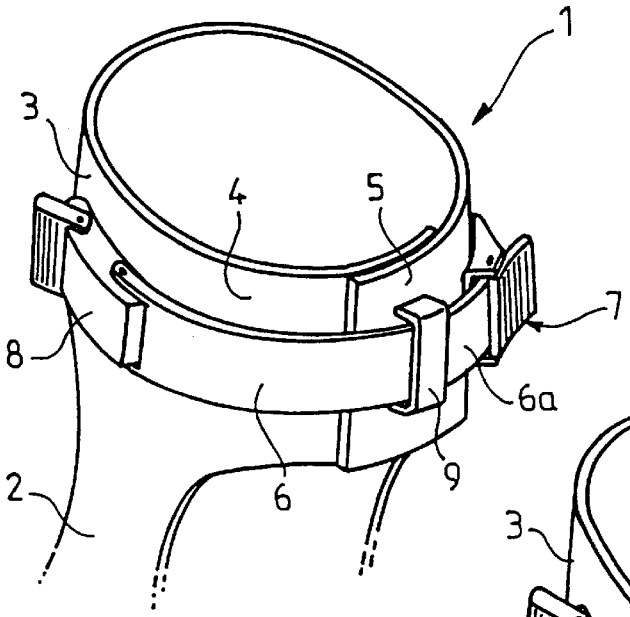
FIG. 1 is a perspective partial view of a boot according to the invention more particularly show in its collar.

According to a first example of embodiment of the invention, FIG. 1 partially shows a sport boot 1 constituted in a known manner by an external sole (not shown) overlaid by an upper 2 extended at its upper portion by a rigid collar 3 forwardly openable to allow for the introduction of the user's foot, and adapted to surround the ankle or lower part of the leg of the user. The free ends of the collar 3, which in fact define the opening, are formed by overlapping portions 4 and 5 that are positionable on one another to surround, and ensure the lateral holding of the lower part of the user's leg. This holding is undertaken by means of a tightening member or tightening strap 6 connecting the overlapping portions 4 and 5 to one another and having blocking device 7 for blocking the overlapping portions into position.

In fact, the tightening strap 6, made of a rigid material, is connected to the internal 4 and external 5 overlapping portions, respectively via a journal system 8 and a removable attachment and blocking system 7 which is capable of cooperating with the free end 6*a* of the tightening strap 6 to block it in a predetermined tightening position.

These systems, whether the journal system 8 or the blocking system 7, are known and, therefore, will not be described herein. The blocking system 7, for example, can be constituted by a cam system.

According to the invention, the collar 3 includes means for the mutual immobilization of the overlapping portions 4 and 5 with respect to one another, along a vertical plane, during taking of lateral support, i.e., while the collar provides support against lateral forces from the ankle or lower leg. The means for immobilization in the vertical direction make it possible to avoid any effect of mutual rotation of the overlapping portions.

Still according to the example of embodiment of FIG. 1, the means for rotational immobilization of the overlapping portions 4 and 5 are constituted by a rigid guide 9, shown in FIG. 1 as a member projecting from overlapping portion 5, the guide 9 having an opening with a height substantially identical to the height of the strap 6 which freely extends through it, the guide 9 being obtained affixedly with the external overlapping portion 5 and positioned between the two ends of the strap 6 affixed to each overlapping portion 4 and 5.

It is readily understood that the projecting member or firm cooperation of the strap 6 affixed to each overlapping portion 4 and 5 with the guide 9 affixed to one of these overlapping portions, in this case the external portion 5, will efficiently contribute to avoid the twisting phenomenon mentioned in the disclosure of the problem to be solved.

Figure 2:
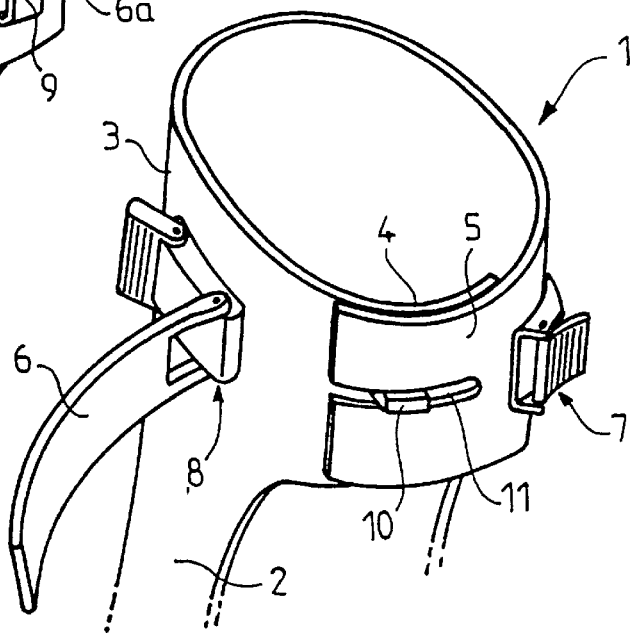
FIG. 2 is a view similar to FIG. 1 according to another embodiment of the collar.

The second embodiment shown in FIG. 2 differs from the previous one essentially in that the means for rotational immobilization of the overlapping portions 4 and 5 are constituted by a rigid transversely extending catch 10 obtained affixedly with one of the overlapping portions 4 or 5, and having a height (i.e., the vertical dimension, with reference to the drawing) substantially identical to that of a transversely extending slot 11 obtained on the other overlapping portion 4 or 5, so as to freely slide therein during the tightening operation by action on the strap 6 which comes to cooperate with the means 7 for blockage into position.

Preferably, the catch 10 for the rotational immobilization of the overlapping portions 4 or 5 is a projection member having a rectangular, more precisely parallelepipedic, cross section.

According to the present examples, the catch 10 extends from the internal overlapping portion 4 and cooperates with the slot 11 of the external overlapping portion 5.

Of course, the opposite is perfectly possible.

Likewise, according to the present example, the slot shown is open at the end of the external overlapping portion 5, but it could very well be closed at each end.

Figure 3:
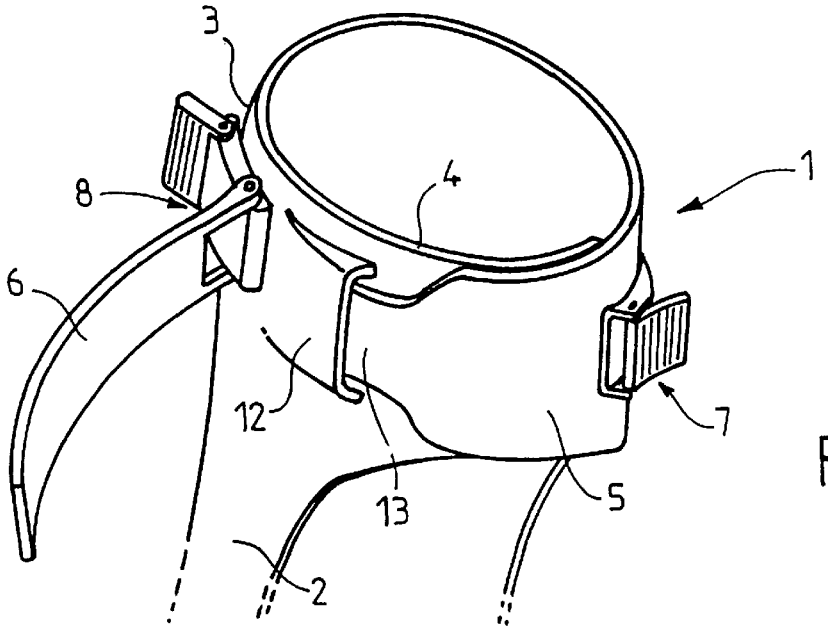
FIG. 3 is a view similar to FIG. 1 according to a third embodiment of the collar.

The example of embodiment of FIG. 3 differs from the previous ones essentially in that the projection member is constituted by a rigid guide 12 provided on the internal overlapping portion 4. The guide 12 has an opening with a height that corresponds substantially to that of a tongue 13 obtained through a transverse extension of the end of the external overlapping portion 5, such that the tongue 13 freely slides in the guide 12 during the tightening operation by action on the strap 6 which comes to cooperate with the blocking means 7.

According to the present example of FIG. 3, the guide 12 is constituted by a housing that is externally closed, i.e., it serves to enclose the end of the tongue 13, but it opens within the collar, the depth of the housing being provided so as to allow for the sliding of the tongue 13 of the external overlapping portion 5.

One could very well envision the guide 12 to be in fact constituted by a corresponding slot provided in the overlapping portion 4, in which case the tongue 13 would open within the collar.

In spite of the structural differences among the embodiments of FIGS. 1, 2, and 3, each of the embodiments includes structures for performing a common function. Specifically, each includes a projecting member on one of the overlapping portions which cooperates with a part of the other overlapping portion, or structure affixed to the other overlapping portion, to prevent relative vertical movement between the overlapping portions of the collar, particularly when lateral forces are imposed on the collar tending to produce such relative movement. In FIG. 1, the upper and lower surfaces of the tightening strap 6 engage upper and lower surfaces of the rigid guide 9 for this purpose. Similarly, in FIG. 2 upper and lower surfaces of the rigid catch 10 engage the upper and lower surfaces that define the slot 11 and, in FIG. 3, upper and lower surfaces of the tongue 13 engage upper and lower surfaces of the rigid guide 12.

The instant application is based upon the French Priority Patent Application No. 96.06699, filed on May 28, 1996, the disclosure of which is hereby expressly incorporated by reference thereto, and the priority of which is hereby claimed under 35 U.S.C. §119.

What is claimed:

1. A sport boot comprising:

an upper;

a rigid collar extending upwardly from said upper and being forwardly openable, said rigid collar surrounding at least one of a user's ankle and lower leg portion to ensure lateral holding, said rigid collar having overlapping portions;

a tightening member to secure said overlapping portions together in a tightened position during a tightening of said rigid collar, said tightened position defining an extent of overlapping of said overlapping portions from among a plurality of extents of overlapping between said overlapping portions; and a first of said overlapping portions having a projecting member positioned for engagement with one of (1) a second of said overlapping portions and (2) structure affixed to the second of said overlapping portions to comprise means, during lateral flexing movement of said rigid collar relative to said upper and in all of said plurality of overlapping extents between said overlapping portions, for preventing rotation of said overlapping portions one relative to the other along a substantially vertical plane.

2. A sport boot according to claim 1, wherein:

said tightening member comprises a strap having a predetermined height, said strap comprising said structure affixed to the second of said overlapping portions, said second of said overlapping portions being an internal overlapping portion; and said projecting member comprises a rigid guide affixed to an external overlapping portion, said external overlapping portion constituting the first of said overlapping portions, said rigid guide having an opening with a height substantially identical to said predetermined height of said strap, said strap extending through said opening.

3. A sport boot according to claim 1, wherein:

said tightening member is affixed to one of said overlapping portions; and the sport boot further comprises a blocking device mounted on another of said overlapping portions for engagement with said tightening member.

4. A sport boot according to claim 3, wherein:

said tightening member comprises a rigid strap having a predetermined height, said strap comprising said structure affixed to the second of said overlapping portions, said second of said overlapping portions being an internal overlapping portion, said strap having two ends, a first of said two ends being affixed to said internal overlapping portion;

said blocking device is adapted to engage a second of said two ends of said strap; and said projecting member is a rigid guide affixed to an external overlapping portion, said rigid guide having an opening with a height substantially identical to said predetermined height of said strap, said strap extending through said opening and engaging said rigid guide between said two ends of said strap.

5. A sport boot according to claim 1, wherein:

said projecting member comprises a rigid transverse catch affixed to one of said first and second overlapping portions, said rigid transverse catch having a predetermined height; and another of said first and second overlapping portions has a transverse slot, said transverse slot having a height substantially identical to said predetermined height of said transverse catch, said transverse catch being adapted to slide freely within said transverse slot during the tightening of the rigid collar.

6. A sport boot according to claim 5, wherein:

said transverse catch has a rectangular cross section.

7. A sport boot according to claim 5, wherein:

said rigid transverse catch is affixed to an internal overlapping portion and said slot is provided in an external overlapping portion.

8. A sport boot according to claim 6, wherein:

said rigid transverse catch is affixed to an internal overlapping portion and said slot is provided in an external overlapping portion.

9. A sport boot according to claim 1, wherein:

said projecting member comprises a rigid guide affixed to an internal overlapping portion, said internal overlapping portion constituting the first of said overlapping portions, said rigid guide having an opening with a predetermined height; and said second of said overlapping portions is an external overlapping portion with a transversely extending tongue, said tongue having a height substantially identical to said predetermined height of said opening of said rigid guide, said tongue being adapted to slide freely within said opening during the tightening of said rigid collar.

10. A sport boot according to claim 9, wherein:

said rigid guide comprises an externally closed housing.

11. A sport boot according to claim 10, wherein:

said closed housing has a predetermined depth allowing sliding of said tongue within said closed housing.

12. A sport boot according to claim 1, wherein:

said overlapping portions comprise internal and external overlapping portions; and said tightening member comprises a tightening strap having a free end, said tightening strap being securely affixed to one of said internal and external overlapping portions by means of a journal system, said tightening strap being removably affixed to another of said internal and external overlapping portions by means of an attachment and blocking system adapted to engage and block said free end of said tightening strap in a predetermined tightened position.

13. A sport boot comprising:

an upper;

a rigid collar extending upwardly from said upper and being forwardly openable, said rigid collar surrounding at least one of a user's ankle and lower leg portion to ensure lateral holding, said rigid collar having overlapping portions;

a tightening and blocking system for tightening said overlapping portions of said rigid collar in a tightened position and for blocking said overlapping portions of said rigid collar in said tightened position, said tightened position defining an extent of overlapping of said overlapping portions from among a plurality of extents of overlapping between said overlapping portions;

a first of said overlapping portions having a projecting member, said projecting member having upper and lower engagement surfaces; and a second of said overlapping portions having a structure for cooperating with said projecting member of said first of said overlapping portions, said structure of said second of said overlapping portions having upper and lower engagement surfaces for engagement with said upper and lower engagement surfaces of said projecting member, in all of said plurality of overlapping extents between said overlapping portions, for immobilizing said overlapping portions against vertical movement relative to one another.

14. A sport boot according to claim 13, wherein:

said tightening and blocking system comprises a strap having a predetermined height, said strap comprising said structure affixed to the second of said overlapping portions, said second of said overlapping portions being an internal overlapping portion; and said projecting member comprises a rigid guide affixed to an external overlapping portion, said external overlapping portion constituting the first of said overlapping portions, said rigid guide having an opening with a height substantially identical to said predetermined height of said strap, said strap extending through said opening.

15. A sport boot according to claim 13, wherein:

said projecting member comprises a rigid transverse catch affixed to said first overlapping portion, said rigid transverse catch having a predetermined height; and said structure of said second overlapping portion defines a transverse slot, said transverse slot having a height substantially identical to said predetermined height of said transverse catch, said transverse catch being adapted to slide freely within said transverse slot during the tightening of the rigid collar.

16. A sport boot according to claim 15, wherein:

said transverse catch has a rectangular cross section.

17. A sport boot according to claim 15, wherein:

said first overlapping portion is an internal overlapping portion, said rigid transverse catch being affixed to said internal overlapping portion; and said second overlapping portion is an external overlapping portion, said slot being provided in said external overlapping portion.

18. A sport boot according to claim 13, wherein:

said first overlapping portion is an internal overlapping portion;

said projecting member comprises a rigid guide affixed to said internal overlapping portion, said rigid guide having an opening with a predetermined height; and said second of said overlapping portions is an external overlapping portion with a transversely extending tongue, said tongue having a height substantially identical to said predetermined height of said opening of said rigid guide, said tongue being adapted to slide freely within said opening during the tightening of said rigid collar.

19. A sport boot according to claim 18, wherein:

said rigid guide comprises an externally closed housing.

20. A sport boot according to claim 19, wherein:

said closed housing has a predetermined depth allowing sliding of said tongue within said closed housing.

* * * * *